XR 4,291,536

XZ 50/506.1

United Sta

Girard

[11] 4,291,536

[45] Sep. 29, 1981

[54] APPARATUS ENABLING THE STORAGE OF RADIOACTIVE WASTES AND THE RECOVERY OF THE EXTRANEOUS HEAT EMITTED THEREBY, AND A STORAGE ELEMENT FOR INCORPORATION IN SUCH APPARATUS

[75] Inventor: Edmond Girard, Boulogne, France

[73] Assignee: Messier S.A., Paris, France

[21] Appl. No.: 892,682

[22] Filed: Apr. 3, 1978

[30] Foreign Application Priority Data

Apr. 22, 1977 [FR] France ..... 77 12146

[51] Int. Cl.[3] ..... F01K 15/00

[52] U.S. Cl. ..... 60/644; 250/506

[58] Field of Search ..... 165/106; 250/506; 60/644

[56] References Cited

U.S. PATENT DOCUMENTS

| | | | |
|---|---|---|---|
| 3,113,215 | 12/1963 | Allen | 250/506 |
| 3,414,727 | 12/1968 | Bonilla | 250/506 |
| 3,619,616 | 11/1971 | Smith | 250/506 |
| 3,845,315 | 10/1974 | Blum | 250/506 |
| 3,911,684 | 10/1975 | Busey | 60/644 |
| 4,147,938 | 4/1979 | Heckman | 250/506 |

FOREIGN PATENT DOCUMENTS

| | | | |
|---|---|---|---|
| 368243 | 5/1963 | France | 250/506 |

*Primary Examiner*—Allen M. Ostrager

*Attorney, Agent, or Firm*—McAulay, Fields, Fisher & Nissen

[57] ABSTRACT

A storage element for use in the recovery of heat originating from the cooling of radioactive wastes including a first element for the storage of radioactive waste having a first closed shell including the wastes, and disposed within a second closed shell, both shells being of generally spherical shape, the second shell bristling with externally projecting radial points or spines, the value between the two shells being filled with a non-contaminatable fluid, promoting the transfer of heat originating from the cooling of the wastes from the first towards the second shell, of which the points or spines serve as radiators in relation to the external medium. Apparatus is also provided which includes a heat pump and an evaporator, for the storage of radioactive wastes and the recovery of extraneous heat emitted by these wastes, which includes at least one of the aforesaid storage elements in which the third shell is traversed by a cold generating fluid issuing from the condenser of the heat pump after reduction in the pressure thereof, and the outlet is connected with a compressor for delivering to the condenser, where the cold generating fluid gives up to a utilization circuit the heat emitted by the wastes and recovered within the evaporator.

11 Claims, 2 Drawing Figures

Figure 1:
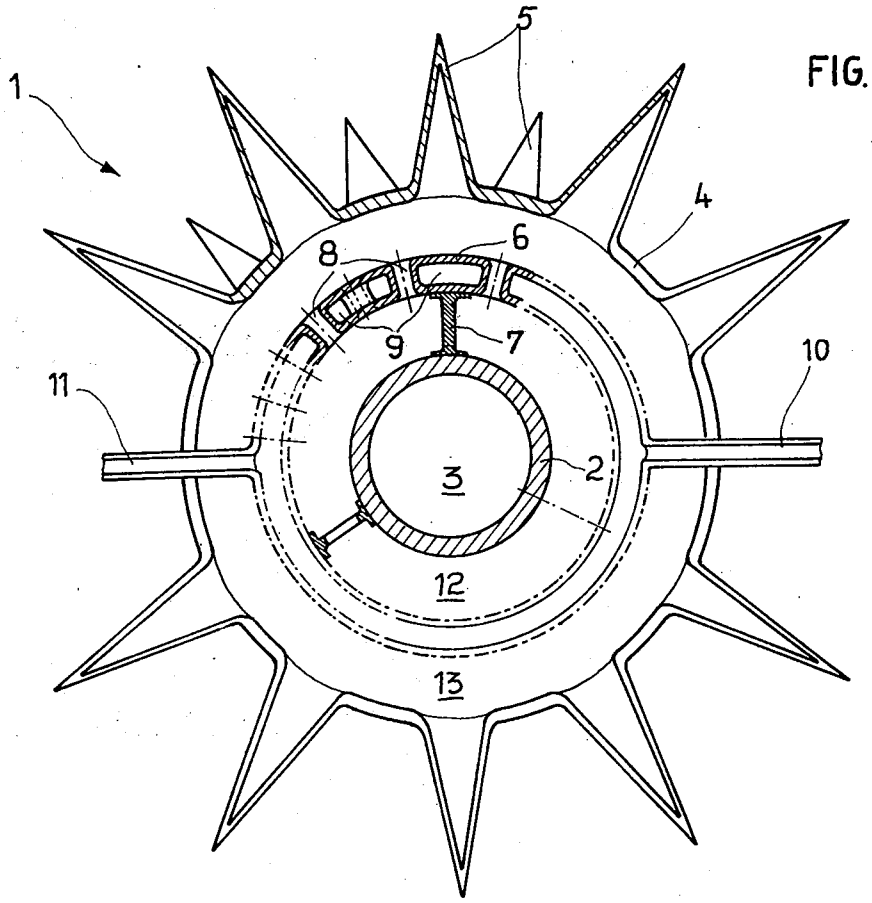

APPARATUS ENABLING THE STORAGE OF RADIOACTIVE WASTES AND THE RECOVERY OF THE EXTRANEOUS HEAT EMITTED THEREBY, AND A STORAGE ELEMENT FOR INCORPORATION IN SUCH APPARATUS

The present invention relates to an apparatus enabling the storage of radioactive wastes and the recovery of the extraneous heat emitted thereby, and a storage element for incorporation in such an apparatus.

It is known that the products resulting from nuclear fission present a danger of which the nature is threefold. Firstly, they exhibit a radioactivity of which the duration can vary from several fractions of a second to several thousand million years. At the same time, they thermally pollute their environment by emitting heat, this phenomenon inevitably accompanying their radioactive decay. Finally, when deenergised, these products remain dangerous chemical poisons.

As is disclosed in U.S. Pat. No. 3,911,684, the production of electrical energy of nuclear origin is accompanied at the present time by the production of large quantities of fission products and of other radioactive wastes, which pose delicate problems of handling and of storage or of ensilage. The potential uses of these products would appear to be of three orders: sources of radiation, sources of heat, or again, sources of valuable elements such as Palladium. However, the demand for fission products as radioactive sources is weak, and does not correspond with the quantity of these products actually disposable. On the other hand, attempts have not been made to develop, in a significant manner, the possibilities of using the extraneous heat diffused and of the production of valuable elements. The spent combustible elements, such as those which are removed from nuclear reactors, contain Uranium, Plutonium, and possibly Thorium, which are sufficiently valuable elements that their recovery, with a view to further use, is justified. Normally, the spent combustibles are dissolved, and the valuable constituents are extracted from the solution by means of suitable solvents. The fission products and the other materials remaining in solution constitute highly radioactive wastes, which must be dealt with over a long period. For example, these wastes are enclosed in a sheath comprising an antiradiation shield, and immersed, for a duration of two to ten years, in a bath, of which the water adopts a temperature of 30° to 60° C., as a result of absorbing the extraneous heat emitted by these wastes. At the end of which, these wastes are sealed in barrels of cement or lead, which are buried in specific sites allocated to serve for the discharge of these products. The composition of the radioactive wastes varies as a function of the nature of the combustibles and that of their cladding, of the extent of combustion, of the processes utilised for the reprocessing of the combustible and the treatment of the wastes, and of the temperature of cooling. A period of recooling of approximately 6 months must run between the extraction of the spent combustible from the core of a nuclear reactor and the completion of the reprocessing of the combustible.

The very radioactive wastes contain, inter alia, fission products, actinide elements, and the materials of the cladding. When this mixture has been converted to one of the different possible solid forms, it constitutes a suitable source of heat for utilisation according to U.S. Pat. No. 3,911,684.

Another suitable source according to this Patent is constituted by a mixture of elements with a long half-life, which diffuse heat and have been separated from the mass of the wastes with a view to selective storage. The object of such a separation is to diminish the importance of the problem which is posed by the elimination of the heat during storage of the residue of the wastes. At the present, Strontium 90 and Cesium 137 are separated from the other radioactive wastes with this object. According to one known process, the Strontium and the Cesium are disposed within double walled cylindrical capsules or cartridges, formed of stainless steel, 60 cm in length and 10 cm in diameter, which are immersed in a bath assuring protection against the radiation of these very radioactive elements and their cooling. The actinides with a high atomic number which accumulate when Plutonium is recycled as a nuclear combustible, constitute other sources of heat. Finally, if the elements having heat generating isotopes with a half-life more than about 2 years are separated from the other wastes, there is obtained a concentrated and useful heat source.

According to U.S. Pat. No. 3,911,684, the suitable sources of heat, as have just been defined, are solidified, placed in cartridges and transported to a treatment installation where the cartridges are lowered into vertical storage tubes, disposed in a heating chamber, possibly below the level of the ground. The storage tubes are cooled by a flow of gas at a suitable temperature, pressure and speed extending between the heating chamber and a cooling chamber where the reheated gas gives up its heat to the fluid of a utilisation circuit via the intermediary of exchangers, the fluid of the utilisation circuit being able to satisfy industrial or agricultural needs or even driving a turbine. The storage tubes have a sufficient capacity that the first cartridges introduced fill only a part of their volume, in such a manner that new cartridges can be periodically introduced, in order to compensate the fall in activity of the older cartridges, in order that the quantity of heat liberated is relatively constant during a long period of operation of the installation.

Such an installation however presents a grave disadvantage, for it is necessary to wait until the last cartridges introduced into the tubes are cooled in order to be able to proceed with the renewal of the oldest cartridges, which have been inert for a long time, involving a loss of time and a considerable loss of yield from the installation.

The object of the present invention is to provide a device permitting the storage of radioactive wastes, and the recovery of the extraneous heat emitted, which does not exhibit this disadvantage and in which one can immediately substitute a given quantity of inert wastes with an equivalent quantity of wastes to be cooled.

The invention accordingly provides an element for the storage of radioactive waste, comprising a first closed shell, of spherical shape, including the wastes, and disposed within a second closed shell, of generally spherical shape and bristling with externally projecting radial points or spines, the volume between the two shells being filled with a non-contaminatable fluid, promoting the transfer of calories originating from the cooling of the wastes from the first towards the second shell, of which the points or spines serve as radiators in relation to the external medium.

It should be noted that storage elements of this type can advantageously replace the cartridges used in the known apparatus. An element or an assembly of storage elements according to the invention can be swept by a flow of fluid, even immersed in a flow of liquid, which is heated by contact with the radiator which is comprised by the external shell and the points or spines with which it is provided, this reheated fluid being able to give up calories in a known fashion to a utilisation circuit.

In accordance with a preferred embodiment of the invention, the storage element further comprises a third spherical shell, enclosing the first shell and enclosed by the second, penetrated by radial passages, and within the thickness of which is provided a network of channels, isolated from the radial passages and capable of being placed in communication, via two conduits integral with the third shell and passing through the second, with a circuit of cold generating fluid, in such a manner that the circulation of this cold generating fluid within the third shell enables a recovery and an evacuation of heat, with a view to utilisation thereof, externally of the element, the possible excess of calories emitted by the wastes being dissipated by the second shell and the points comprised thereby towards the external medium.

An apparatus according to the invention, permitting the storage of radioactive waste and the recovery, with a view to exploitation thereof, of the extraneous heat emitted by these wastes, comprises at least one storage element according to the preferred embodiment referred to above, of which the third shell, which is traversed by a cold generating fluid issuing from the condenser of a heat pump, after reduction in the pressure thereof, constitutes the evaporator of this heat pump, of which the outlet is connected with a compressor delivering to the condenser, where the cold generating fluid gives up to a utilisation circuit the calories emitted by the wastes and recovered within the evaporator.

Figure 2:
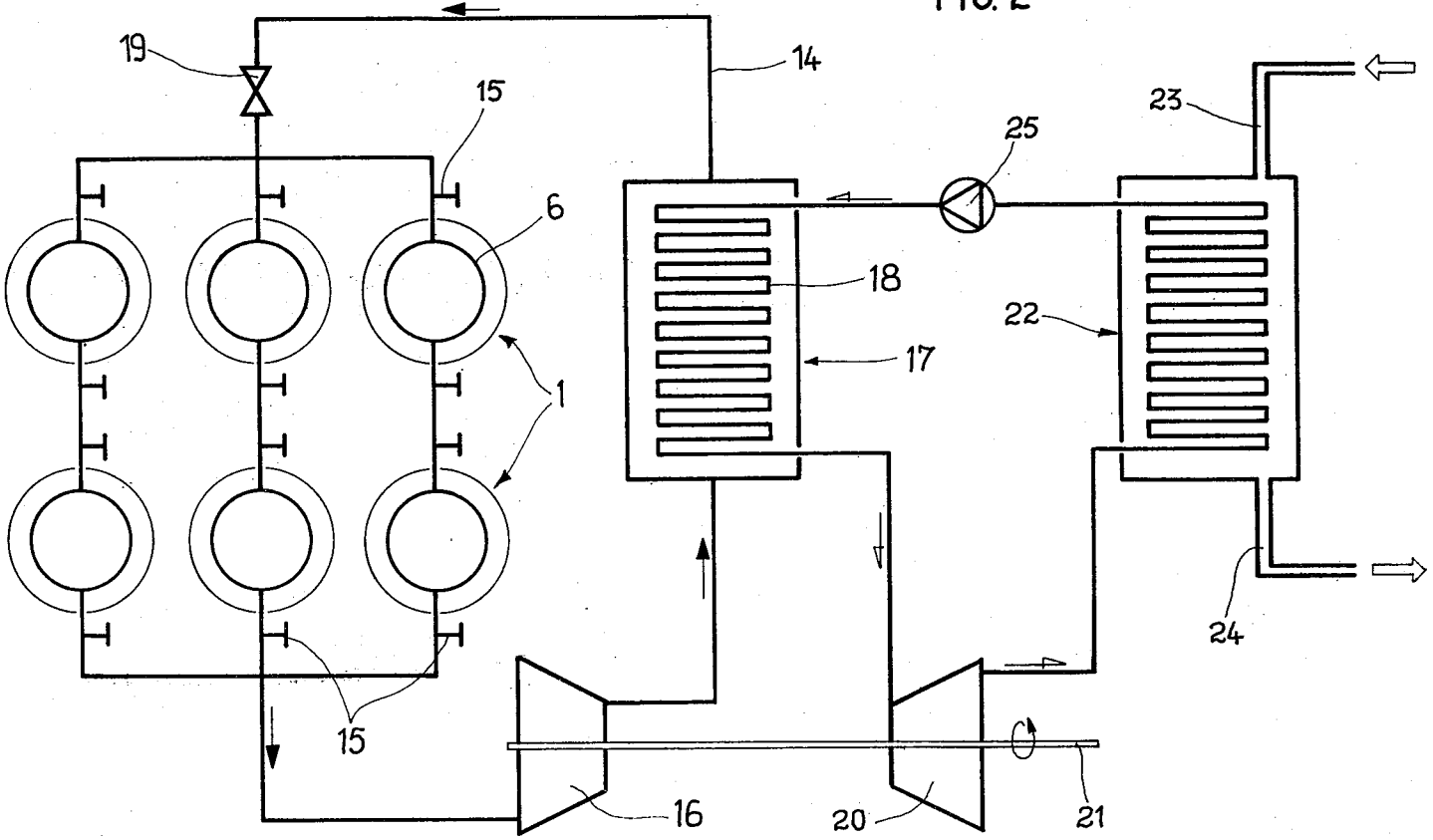

The invention is illustrated by way of example in the accompanying drawings, in which FIG. 1 is a sectional view passing through the centre of an element for storage of radioactive waste and the recovery of extraneous heat emitted by the latter, in accordance with one embodiment of the invention, and FIG. 2 is a diagrammatic illustration of an installation for the storage of wastes and the recovery of heat, utilising elements according to FIG. 1.

Referring to FIG. 1, the storage element shown has a shape and structure which is reminiscent of those of radiolarians with spherical shells, bristling with spines and encased within one another, which one finds amongst microorganisms living in the plankton of the ocean. This storage element comprises a first closed shell 2, of spherical shape, within which is sealed a limited mass 3 of radioactive waste, previously vitrified, this vitrification assuring a first neutralisation of the radiation. The shell 2 is formed of a composite material of gold and lead, these metals being chosen because the first exhibits an excellent thermal conductivity, and the second constitutes a second antiradiation barrier. The shell 2 is disposed within another closed shell 4, of generally spherical form and provided with points 5 extending radially outwardly from the exterior, the shell 4 and the points 5 being formed in a composite material of copper and lead, combining the favourable thermal conductivity of copper with the properties of lead as an antiradiation screen.

A third shell 6, likewise formed in a composite material of gold and lead, enclosing the shell 2, to which it is connected via braces 7 of copper, and enclosed by the external shell 4, defines radial passages 8 and an array of channels 9, which extend within the thickness of the shell 6, without communicating with the radial passages 8.

Two conduits 10 and 11, integral with the shell 6 and connecting with the array of channels 9, pass through the external shell 4 and support the assembly of shells 2 and 6 within the interior of the external shell 4.

Finally, the two chambers 12 and 13, that the intermediate shell 6 defines respectively with the shells 2 and 4, are filled with a fluid non-contaminatable by radiation and promoting the thermal transfer, such as demineralised water, which can pass from one of the chambers 12 and 13 to the other through the radial passages 8. The element 1 thus obtained constitutes a receptacle for the storage of vitrified radioactive waste, associated on the one hand with a radiator, and on the other hand with a possible thermal screen, obtained by circulation of a cold generating fluid, such as freon, in the array of channels 9 of the intermediate shell 6.

Referring to FIG. 2, an installation for the storage of radioactive waste and the recovery of the extraneous heat emitted thereby comprises an array of elements 1, advantageously disposed in an array comprising different parallel lines of elements 1 connected in series, the array being connected to the cold generating fluid circuit 14 of a heat pump. To this end, the conduits 10 and 11 constitute, for each element 1, respectively the inlet and outlet conduits for the cold generating fluid, and are provided with valves 15 of known type, enabling the isolation of each element 1 from the array. The array of thermal screens constituted by the shells 6 and the arrays of channels 9 constitutes the evaporator of the heat pump, in which the cold generating fluid evaporates upon absorption of the extraneous calories emitted by the radioactive waste 3 and transmitted by the shell 2 and the demineralised water of the chambers 12 and 13 through the walls of the shell 6, the excess heat being evacuated to the exterior by way of the shell 4 and the points 5. The cold generating fluid thus reheated is then conducted to the compressor 16 of the heat pump then to the condenser 17 including the boiler tube 18 of a low pressure steam engine. After having been cooled, the pressure of the cold generating fluid is reduced in the pressure reducer 19, then is returned to the inlets 10 of the elements 1.

At the outlet of the boiler tube 18, the steam from the low pressure steam engine drives a turbine 20 which delivers a mechanical energy disposable by way of the shaft 21 as well as ensuring driving of the compressor 16 of the heat pump. The circuit of the low pressure steam engine is completed by passage through a condenser 22, into which issues at 23 a fluid originating from a cold source, for example the water of the distribution network, which is returned at 24 at a higher temperature, and can possibly serve for agricultural or domestic purposes, a circulation pump 25 assuring the return of the fluid of the low pressure steam engine to the boiler tube 18. The installation thus described is very versatile in operation. As a result, it is possible to proceed with the substitution of a new mass of wastes to be cooled in the place of the wastes which are inert or emit insufficient heat, by isolating the storage element 1 concerned, through operation of the valves 15, and replacing it by a storage element 1 recently charged with waste, without stopping the operation of the installation. Likewise, in the case of a lower need for mechanical energy from the shaft 21, or for a lower need of, for example, domestic heating, the utilisation circuit of the heat pump being possibly a heating circuit and not a low pressure steam engine, it is possible to isolate one or more storage elements 1 in which case the whole of the calories emitted by the waste will be evacuated by way of the external shell 4 and its points or spines 6. It should likewise be noted that the elements 1 may constitute the final storage receptacles for the wastes which they contain when the latter have become inert or slightly active.

What I claim is:

1. A storage element for use in the recovery of heat originating from the cooling of radioactive wastes including a first element for the storage of radioactive waste, comprising a first closed shell of spherical shape including the wastes and disposed within a second closed shell of generally spherical shape and bristling with externally projecting radial points or spines, the volume betwen the two shells being filed with a non-contaminatable fluid, promoting the transfer of heat originating from the cooling of the wastes from the first towards the second shell, of which the points or spines serve as radiators in relation to the external medium, and a second element for the recovery of heat originating from cooling of the wastes in said first element further comprising a third spherical shell enclosing said first shell and enclosed by said second shell penetrated by radial passages and within the thickness of which is provided an array of channels isolated from said radial passages and capable of being placed in communication via two conduits integral with said third shell and passing through said second shell with a circuit of a cold generating fluid circuit in such a manner that the circulation within said third shell of the cold generating fluid permits a recovery and an evacuation of heat to the exterior of the storage element with a view to utilisation thereof, the possible excess of heat emitted by the wastes being dissipated towards the external medium by said second shell and its points or spines.

2. An element according to claim 1, wherein the non-contaminatable fluid is demineralised water.

3. An element according to claim 1 for use in the recovery of calories originating from cooling of the wastes, further comprising a third spherical shell, enclosing the first shell and enclosed by the second, penetrated by radial passages, and within the thickness of which is provided an array of channels, isolated from the radial passages and capable of being placed in communication, via two conduits integral with the third shell and passing through the second, with a circuit of a cold generating fluid circuit in such a manner that the circulation, within the third shell, of the cold generating fluid, permits a recovery and an evacuation of heat to the exterior of the element, with a view to utilisation thereof, the possible excess of calories emitted by the wastes being dissipated towards the external medium by the second shell and its points or spines.

4. An element according to claim 3, wherein the third shell is formed of a composite material of gold and lead.

5. An apparatus enabling the storage of radioactive wastes and the recovery of extraneous heat emitted by these wastes, comprising at least one storage element according to claim 3 or 1, of which the third shell, which is traversed by a cold generating fluid issuing from the condenser of a heat pump, after reduction in the pressure thereof, constitutes the evaporator of this heat pump, of which the outlet is connected with a compressor delivering to the condenser, where the cold generating fluid gives up to a utilisation circuit the calories emitted by the wastes and recovered within the evaporator.

6. An apparatus according to claim 5, wherein the evaporator of the heat pump is formed by the said third shells of an assembly of storage elements connected in parallel.

7. An apparatus according to claim 5, wherein the evaporator of the heat pump is formed by the said third shells of an assembly of storage elements connected in series.

8. An apparatus according to claim 5, wherein the utilisation circuit is a low pressure steam engine, of which the boiler tube is integral with the condenser of the heat pump, the steam issuing from the boiler tube being discharged to a turbine for driving the compressor of the heat pump and simultaneously delivering a disposable mechanical energy.

9. An element according to claim 1, wherein said first shell is formed of a composite of material of lead and gold.

10. An element according to claim 1 or 9, wherein the second shell is formed of a composite material of copper and lead.

11. An element according to claim 10, wherein the third shell is formed of a composite material of gold and lead.

* * * * *